US012270586B2

(12) United States Patent
Sheaffer

(10) Patent No.: US 12,270,586 B2
(45) Date of Patent: Apr. 8, 2025

(54) WATER BOX MIXING MANIFOLD

(71) Applicant: Johnson Controls Tyco IP Holdings LLP, Milwaukee, WI (US)

(72) Inventor: Bryson Lee Sheaffer, Mechanicsburg, PA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 199 days.

(21) Appl. No.: 17/802,489

(22) PCT Filed: Feb. 26, 2021

(86) PCT No.: PCT/US2021/020071

§ 371 (c)(1),
(2) Date: Aug. 25, 2022

(87) PCT Pub. No.: WO2021/174110

PCT Pub. Date: Sep. 2, 2021

(65) Prior Publication Data

US 2023/0143887 A1 May 11, 2023

Related U.S. Application Data

(60) Provisional application No. 62/982,582, filed on Feb. 27, 2020.

(51) Int. Cl.

| | |
|---|---|
| ***F25B 49/02*** | (2006.01) |
| ***F25B 39/00*** | (2006.01) |
| ***F25B 39/04*** | (2006.01) |

(52) U.S. Cl.

CPC ..... *F25B 49/027* (2013.01); *F25B 39/00* (2013.01); *F25B 39/04* (2013.01); *F25B 2339/047* (2013.01); *F25B 2700/21161* (2013.01)

(58) Field of Classification Search

CPC ..... F25B 49/027; F25B 39/00; F25B 39/24; F25B 2339/047; F25B 2700/21161; (Continued)

(56) References Cited

U.S. PATENT DOCUMENTS 6,244,058 B1 6/2001 Duga et al.
9,310,143 B2 * 4/2016 Valente ..... F28D 7/16
(Continued)

FOREIGN PATENT DOCUMENTS

CN 103003653 A 3/2013
CN 105324529 A 2/2016
(Continued)

OTHER PUBLICATIONS

International Search Report and Written Opinion for PCT Application No. PCT/US2021/020071, mailed Jun. 18, 2021, 11 pages.
(Continued)

*Primary Examiner* — Kun Kai Ma
(74) *Attorney, Agent, or Firm* — Fletcher Yoder, P.C.

(57) ABSTRACT

A heating, ventilation, air conditioning, and refrigeration (HVAC&R) system includes a heat exchanger with a shell having a first pass configured to place a fluid in a heat exchange relationship with a first refrigerant and a second pass configured to place the fluid in a heat exchange relationship with a second refrigerant. The heat exchanger also includes a water box coupled to the shell and configured to direct the fluid from the first pass to the second pass. The HVAC&R system also includes a fluid mixing manifold disposed within the water box, where the fluid mixing manifold is configured to collect and mix a plurality of flows of the fluid from within the water box to generate a mixed fluid, and a sensor coupled to the fluid mixing manifold, where the sensor is configured to measure a parameter of the mixed fluid.

20 Claims, 7 Drawing Sheets

(58) Field of Classification Search
CPC ..... F25B 2339/046; F25B 2400/23; F28D 7/0066; F28D 7/1607; F28F 9/0275; F28F 9/028
See application file for complete search history.

(56) References Cited

U.S. PATENT DOCUMENTS

| | | | | |
|---|---|---|---|---|
| 2002/0179294 | A1* | 12/2002 | Gupte | F28F 9/22 62/524 |
| 2012/0111040 | A1 | 5/2012 | Kohler et al. | |
| 2015/0007604 | A1 | 1/2015 | Hu et al. | |
| 2015/0034284 | A1 | 2/2015 | Sullivan | |

FOREIGN PATENT DOCUMENTS

| | | | | | |
|---|---|---|---|---|---|
| CN | 106461351 | A | | 2/2017 | |
| CN | 108979865 | A | | 12/2018 | |
| CN | 109115012 | A | * | 1/2019 | F28D 7/1623 |
| CN | 110168303 | A | | 8/2019 | |
| EP | 3343160 | B1 | * | 12/2020 | F25B 39/028 |
| JP | H09166370 | A | | 6/1997 | |
| JP | H10132400 | A | | 5/1998 | |
| JP | 2001280865 | A | * | 10/2001 | |
| JP | 2013204506 | A | * | 10/2013 | |
| KR | 101175777 | B1 | | 8/2012 | |
| WO | 2010130064 | A1 | | 11/2010 | |

OTHER PUBLICATIONS

Chinese Office Action for CN Application No. 202180027821.2, dated Feb. 7, 2024, 8 pages.
European Extended Search Report for EP Application No. 21760185.5, dated May 24, 2024, 8 pages.

* cited by examiner

WATER BOX MIXING MANIFOLD

CROSS REFERENCE TO RELATED APPLICATION

This application is a U.S. National Stage Application of PCT International Application No. PCT/US2021/020071, entitled "WATER BOX MIXING MANIFOLD," filed Feb. 26, 2021, which claims priority to and the benefit of U.S. Provisional Application No. 62/982,582, entitled "WATER BOX MIXING MANIFOLD," filed Feb. 27, 2020, each of which is hereby incorporated by reference in its entirety for all purposes.

BACKGROUND

This disclosure relates generally to vapor compression systems, and more particularly, to a system for measuring a fluid temperature in vapor compression systems.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Vapor compression systems, such as chiller systems, utilize a working fluid (e.g., a refrigerant) that changes phases between vapor, liquid, and combinations thereof, in response to exposure to different temperatures and pressures within components of the vapor compression system. The chiller system may place a working fluid in a heat exchange relationship with a conditioning fluid and may deliver the conditioning fluid to conditioning equipment and/or a conditioned environment serviced by the chiller system. In some cases, a heating, ventilation, air conditioning, and/or refrigeration (HVAC&R) system may include multiple chiller systems, and each chiller system may circulate a respective working fluid. Each working fluid may remove heat from a flow of conditioning fluid that is placed in a heat exchange relationship with the respective working fluid via a component (e.g., an evaporator) of the chiller system. In such embodiments, each chiller system may also have a condenser configured to cool heated working fluid. For example, a cooling fluid, such as a water or air flow, may be directed through or across the respective condenser of each chiller system to cool the respective working fluid. The various components of each chiller system may be controlled individually to balance or distribute a load shared by the chiller systems. Unfortunately, variations in the working fluids and/or conditioning fluids at different locations within the chiller systems may complicate effective balancing of the load.

SUMMARY

In an embodiment of the present disclosure, a heating, ventilation, air conditioning, and refrigeration (HVAC&R) system includes a heat exchanger with a shell having a first pass configured to place a fluid in a heat exchange relationship with a first refrigerant and a second pass configured to place the fluid in a heat exchange relationship with a second refrigerant. The heat exchanger also includes a water box coupled to the shell and configured to direct the fluid from the first pass to the second pass. The HVAC&R system also includes a fluid mixing manifold disposed within the water box, where the fluid mixing manifold is configured to collect and mix a plurality of flows of the fluid from within the water box to generate a mixed fluid, and a sensor coupled to the fluid mixing manifold, where the sensor is configured to measure a parameter of the mixed fluid.

In another embodiment, a heat exchanger includes a water box configured to direct a fluid from a first pass of the heat exchanger to a second pass of the heat exchanger and a fluid mixing manifold disposed within the water box. The fluid mixing manifold includes a plurality of sampling conduits configured to collect and mix a plurality of flows of the fluid from a respective plurality of locations within the water box, a mixing junction fluidly coupled to each sampling conduit of the plurality of sampling conduits, where the mixing junction is configured to mix the plurality of flows of the fluid to generate a mixed fluid, and a discharge port fluidly coupled to the mixing junction and configured to discharge the mixed fluid into the water box.

In a further embodiment, a heating, ventilation, air conditioning, and refrigeration (HVAC&R) system includes a heat exchanger having a shell, a water box coupled to the shell, a partition disposed within the shell to define a first volume within the shell and a second volume within the shell, a first subset of tubes disposed within the first volume and configured to direct a fluid into the water box, and a second subset of tubes disposed within the second volume and configured to receive the fluid from the water box. The HVAC&R system also includes a fluid mixing manifold disposed within the water box. The fluid mixing manifold is configured to collect a plurality of flows of the fluid from a respective plurality of locations arrayed along a height of the water box and configured to mix the plurality of flows to generate a mixed fluid. The HVAC&R system further includes a temperature sensor disposed within the fluid mixing manifold and configured to detect a temperature of the mixed fluid.

DRAWINGS

Various aspects of this disclosure may be better understood upon reading the following detailed description and upon reference to the drawings in which.

DETAILED DESCRIPTION

Figure 1:
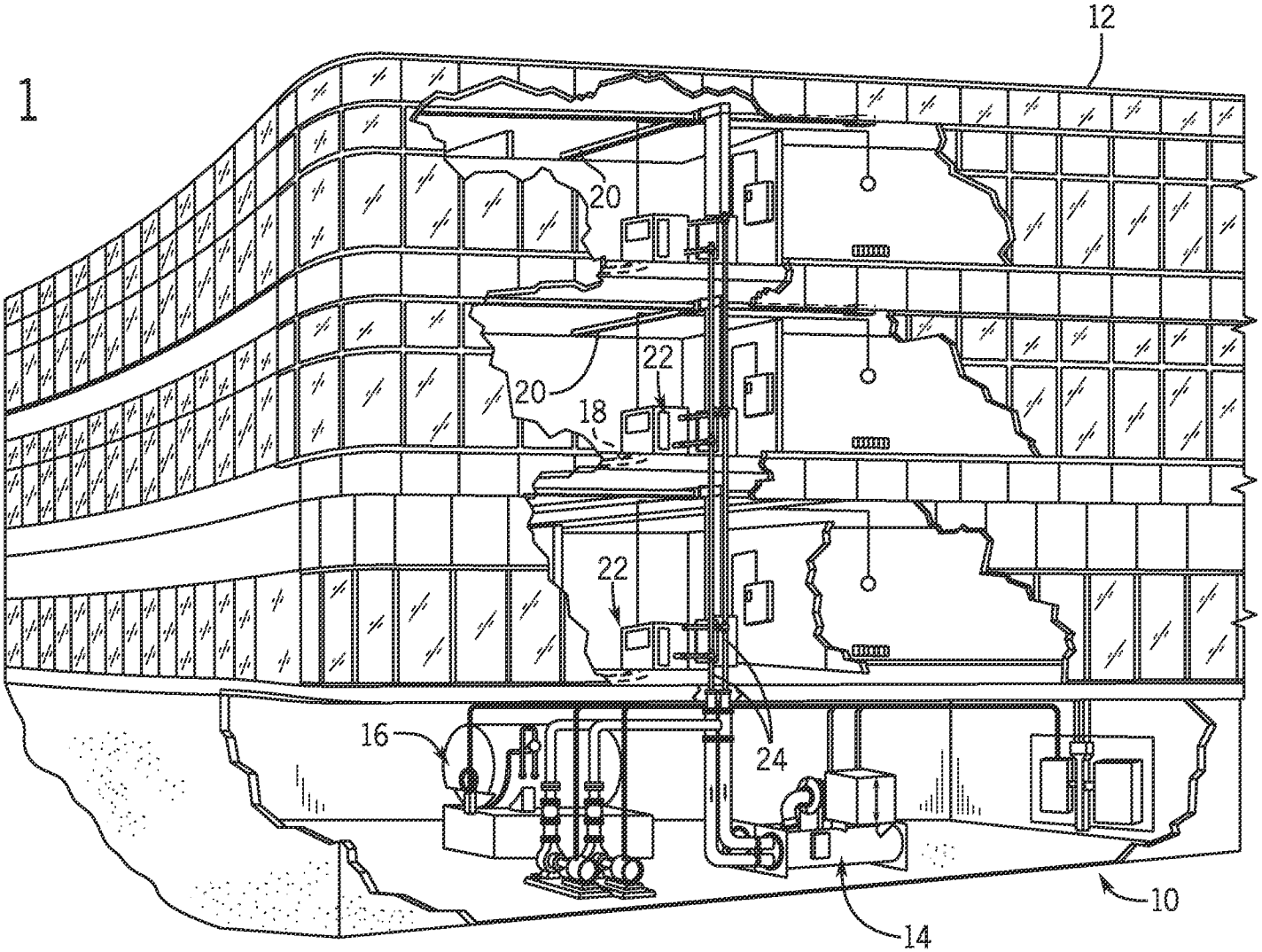
FIG. 1 is a perspective view of an embodiment of a building that may utilize a heating, ventilation, air conditioning, and refrigeration (HVAC&R) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure are directed towards a fluid mixing manifold that may be utilized in a heat exchanger of a vapor compression system, such as a heating, ventilation, air conditioning, and refrigeration (HVAC&R) system. More specifically, present embodiments include a fluid mixing manifold configured to sample fluid from different locations within a heat exchanger and mix the sampled fluids to generate a mixed fluid. The temperature of the mixed fluid may be measured for use in controlling operation of the vapor compression system or other system utilized with the vapor compression system and the heat exchanger.

For example, the heat exchanger may include a shell and a plurality of tubes disposed within the shell that is configured to direct a cooling fluid or conditioning fluid (e.g., water) therethrough. As the cooling or conditioning fluid is directed through the plurality of tubes, a working fluid (e.g., refrigerant) may be directed through the shell of the heat exchanger, such that heat is transferred between the cooling or conditioning fluid and the working fluid. In some embodiments, the heat exchanger may be a multi-pass heat exchanger. That is, the heat exchanger may be configured to direct the cooling or conditioning fluid along a first pass of the heat exchanger to exchange heat with refrigerant (e.g., a first refrigerant) and to subsequently direct the cooling or conditioning fluid along a second pass of the heat exchanger to exchange heat with refrigerant (e.g., a second refrigerant). To this end, the heat exchanger may include a water box (e.g., cooling fluid box, conditioning fluid box, etc.) that is coupled to the shell and is configured to re-direct the cooling or conditioning fluid from the first pass of the heat exchanger to the second pass of the heat exchanger. The plurality of tubes disposed within the shell may be divided into a first subset of tubes that define the first pass and a second subset of tubes that define the second pass. In operation, cooling or conditioning fluid is directed through the first subset of tubes and into the water box, and the water box directs the cooling or conditioning fluid into the second subset of tubes. In some embodiments, the first subset of tubes may be disposed within a first portion of the shell associated with a first refrigerant circuit of the vapor compression system, and the second subset of tubes may be disposed within a second portion of the shell, fluidly separate from the first portion, associated with a second refrigerant circuit of the vapor compression system. As will be appreciated, it may be desirable to control the vapor compression system based on a temperature of the cooling or conditioning fluid within the water box between the first pass and the second pass.

The plurality of tubes may be arranged in bundles within the shell such that the tubes are positioned at different locations (e.g., heights) within the shell. Due to variances in individual heat transfer performance of the tubes (e.g., based on a respective location of each tube within the shell), the cooling or conditioning fluid flowing through the tubes may not be homogeneous in temperature. In other words, the cooling or conditioning fluid exiting one tube of the plurality of tubes may have a different temperature than the cooling or conditioning fluid exiting another tube of the plurality of tubes. For example, the cooling or conditioning fluid directed into the water box via a first tube of the first subset of tubes may have a different temperature than the cooling or conditioning fluid directed into the water box via a second tube of the first subset of tubes. In order to determine an average temperature of the cooling or conditioning fluid within the water box, present embodiments are directed to a fluid mixing manifold configured to sample fluid at different locations within the water box and mix the sampled fluids to generate a mixed fluid. The temperature of the mixed fluid may be measured and may be used to control operation of the vapor compression system. Further, as discussed in detail below, the configuration of the fluid mixing manifold enables more accurate temperature measurements of the fluid for use in controlling operation of the vapor compression system and also enables a reduction in pressure drop of the fluid within the water box compared to traditional systems that are configured to generate a mixed fluid within the water box, such as via baffles disposed within the water box.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
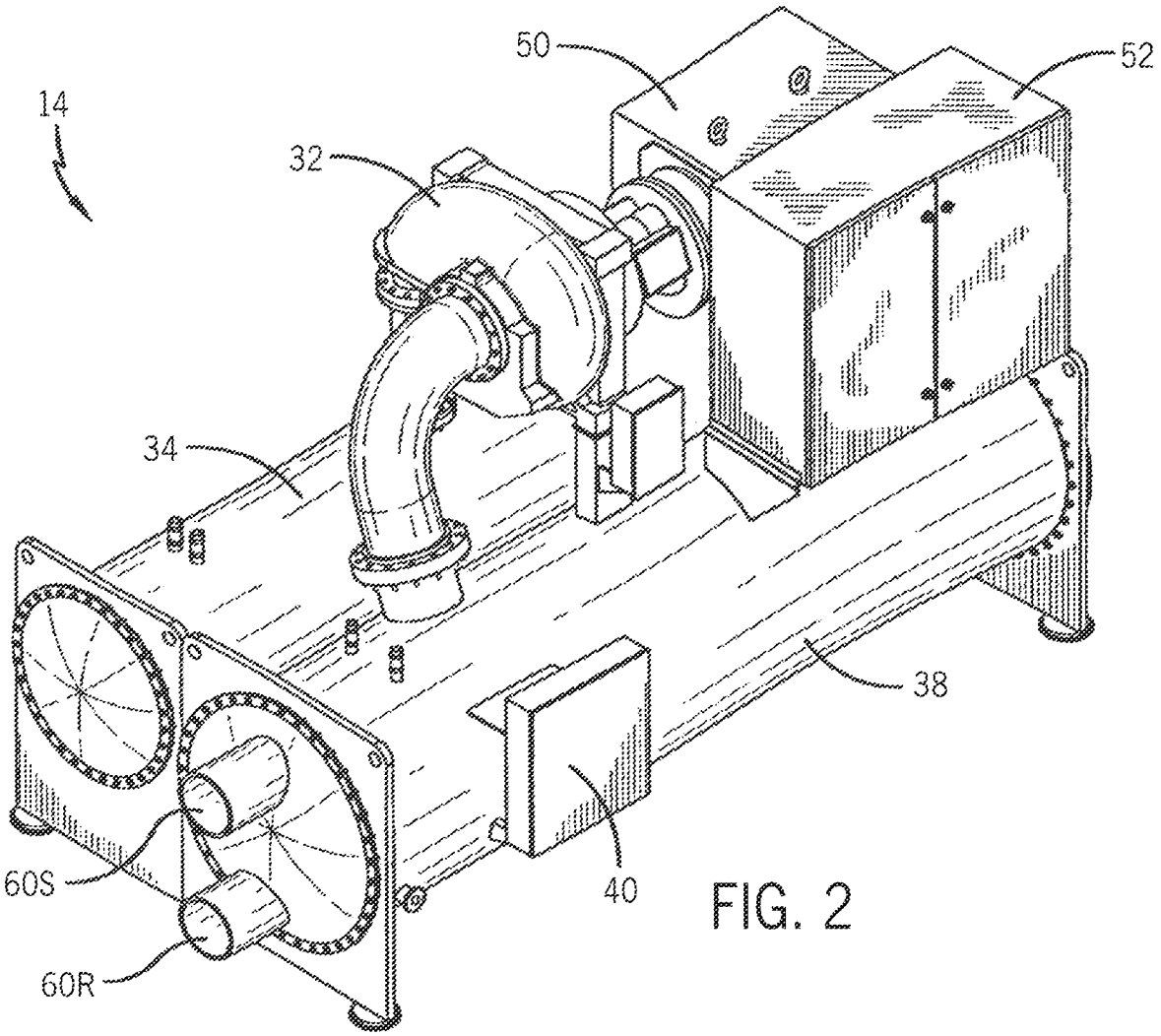
FIG. 2 is a perspective view of an embodiment of a vapor compression system, in accordance with an aspect of the present disclosure.
Figure 3:
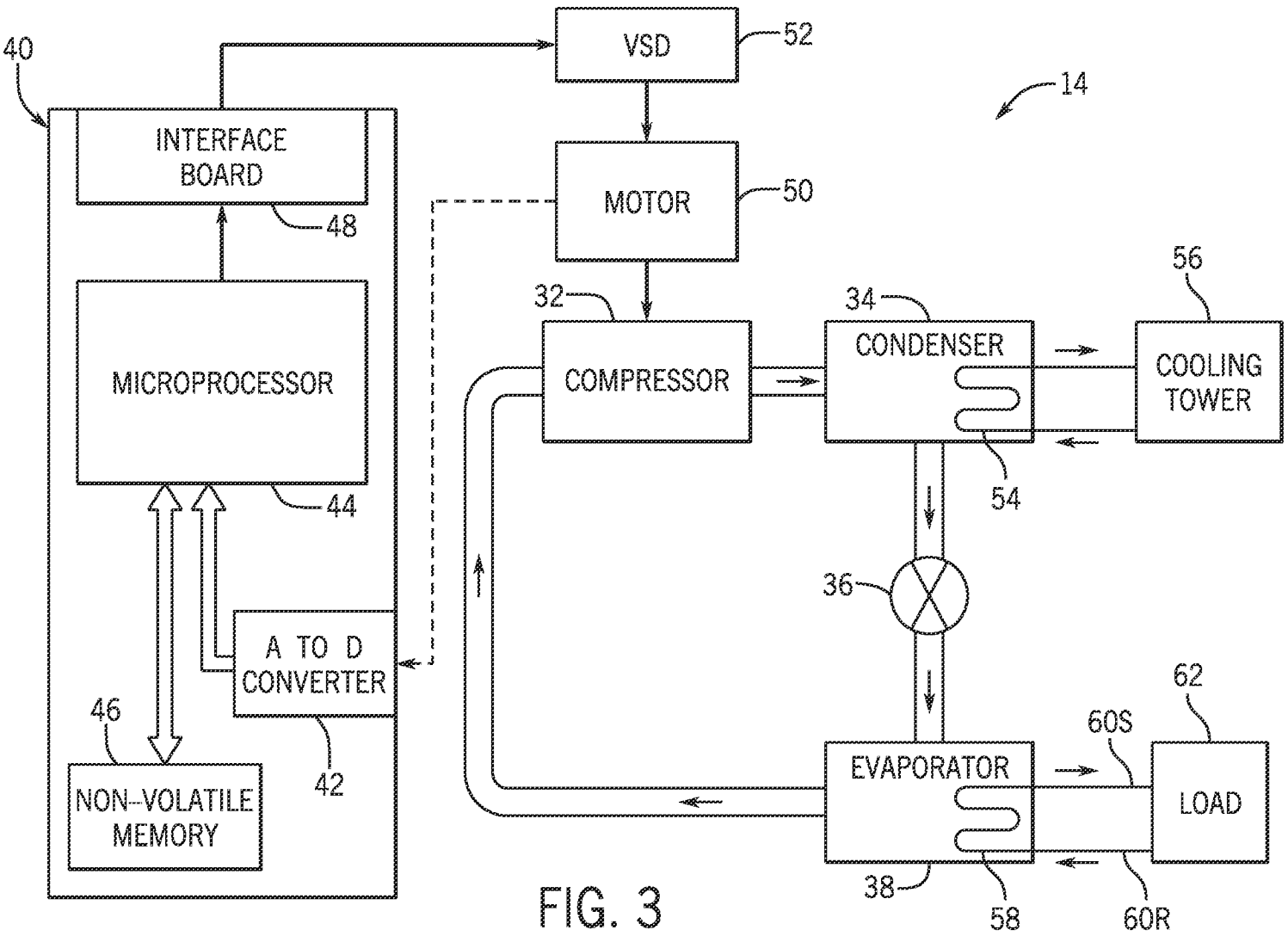
FIG. 3 is a schematic of an embodiment of a vapor compression system, in accordance with an aspect of the present disclosure.

FIGS. 2 and 3 illustrate embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia (NH3), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid (e.g., a conditioning fluid), which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The conditioning fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the conditioning fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
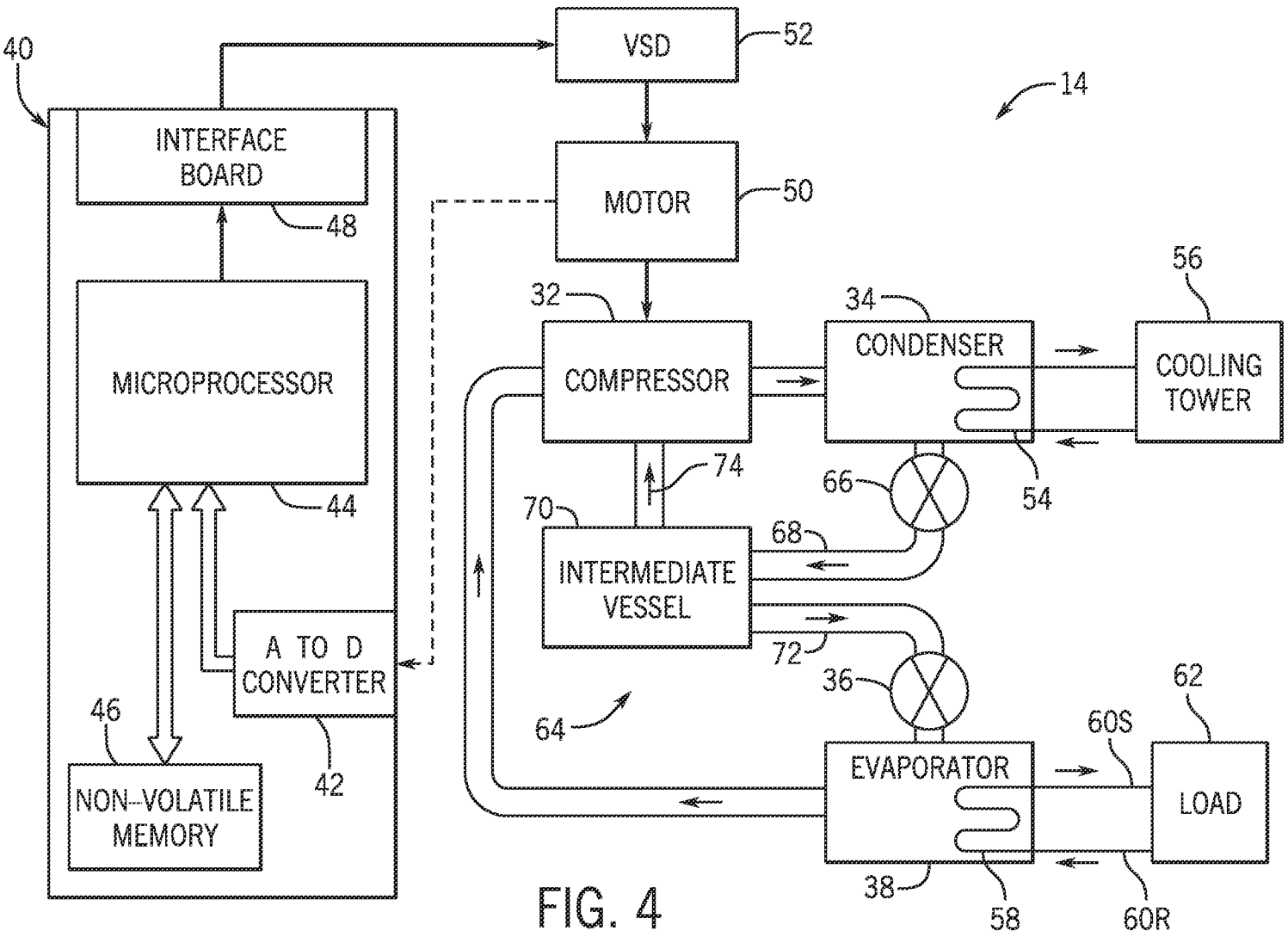
FIG. 4 is a schematic of an embodiment of a vapor compression system of, in accordance with an aspect of the present disclosure.

FIG. 4 is a schematic of an embodiment of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the liquid refrigerant due to a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 due to the expansion in the expansion device 66 and/or the intermediate vessel 70. The liquid from intermediate vessel 70 may then flow in line 72 through a second expansion device 36 to the evaporator 38.

As mentioned above, a heat exchanger of the vapor compression system 14 may include a shell having a plurality of tubes disposed therein, where the plurality of tubes is configured to direct a cooling fluid or conditioning fluid (e.g., water) therethrough, and the shell is configured to direct a working fluid (e.g., refrigerant) therethrough to enable heat transfer between the cooling or conditioning fluid and the working fluid. In some embodiments, the heat exchanger may be a multi-pass heat exchanger configured to direct the cooling or conditioning fluid through multiple passes that are defined by different subsets of tubes. In some multi-pass heat exchanger embodiments, each pass of the heat exchanger may be associated with a separate refrigerant circuit that circulates a respective refrigerant therethrough. For example, the vapor compression system 14 may include multiple refrigerant circuits, and condensers of the multiple refrigerant circuits may be packaged together in a common heat exchanger shell and/or evaporators of the multiple refrigerant circuits may be packaged together in a common heat exchanger shell. The heat exchanger further includes a water box configured to direct the cooling or conditioning fluid from the tubes of the first pass to the tubes of the second pass.

Figure 5:
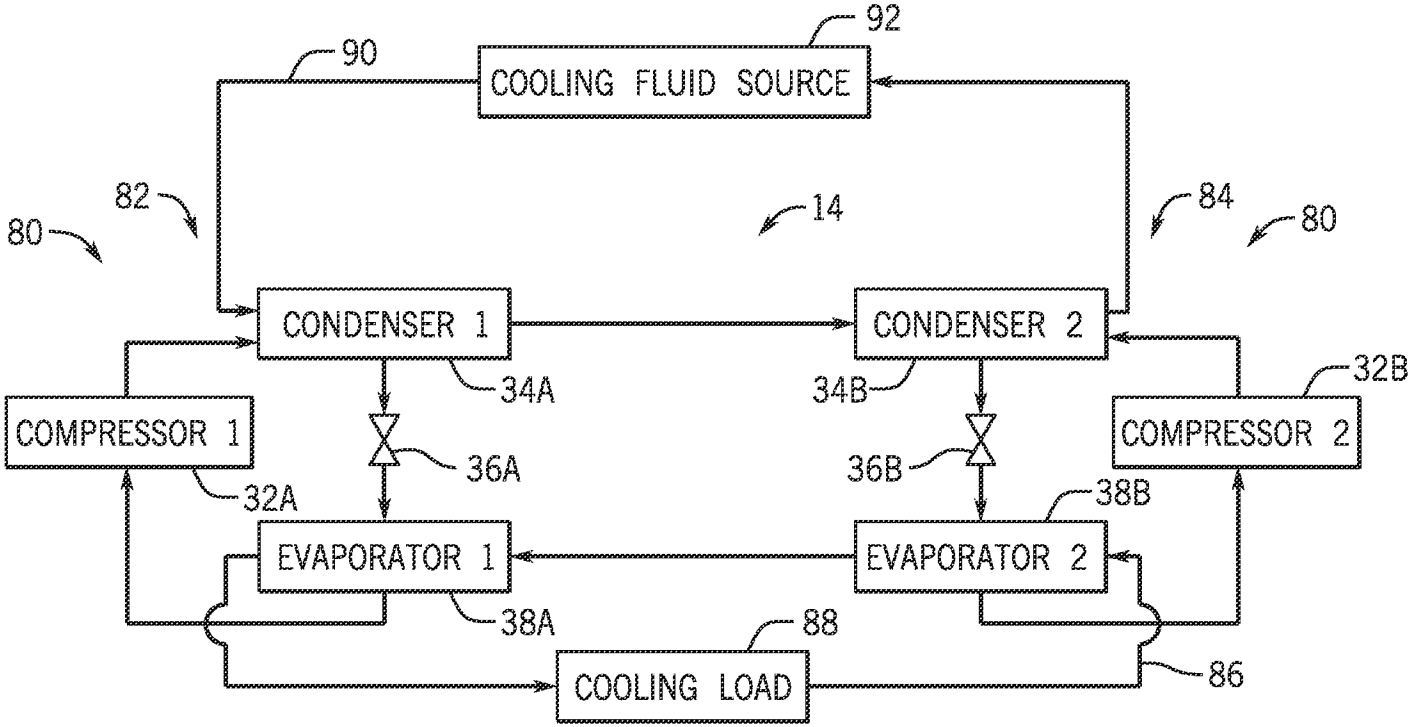
FIG. 5 is a schematic of an embodiment of a vapor compression system having multiple refrigerant circuits in a series counter-flow arrangement, in accordance with an aspect of the present disclosure.

FIG. 5 is a schematic of an embodiment of the vapor compression system 14 with multiple refrigerant circuits 80 (e.g., refrigerant loops). In particular, the illustrated embodiment includes a first refrigerant circuit 82 and a second refrigerant circuit 84 arranged in a series counter-flow arrangement. The first refrigerant circuit 82 includes a first compressor 32A, a first condenser 34A, a first expansion device 36A, and a first evaporator 38A. The second refrigerant circuit 84 includes a second compressor 32B, a second condenser 34B, a second expansion device 36B, and a second evaporator 38B. Each of the refrigerant circuits 80 is configured to circulate a respective refrigerant therethrough and is configured to operate in a manner similar to that described above with reference to the vapor compression system 14 shown in FIGS. 2-4. It should be noted that each of the refrigerant circuits 80 may also include components in addition to those shown in FIGS. 2-4.

In the illustrated embodiment, the first and second refrigerant circuits 82 and 84 of the vapor compression system 14 are arranged in a series counter-flow arrangement. Specifically, the first and second evaporators 38A and 38B define a portion of a conditioning fluid flow path or circuit 86 that extends from a cooling load 88 (e.g., air handlers 22), sequentially through the second evaporator 38B and the first evaporator 38A, and back to the cooling load 88. Similarly, the first and second condensers 34A and 34B define a portion of a cooling fluid flow path or circuit 90 that extends from a cooling fluid source 92 (e.g., cooling tower 56), sequentially through the first condenser 34A and the second condenser 34B, and back to the cooling fluid source 92. Thus, conditioning fluid is directed through the vapor compression system 14 first through the second evaporator 38B and then through the first evaporator 38A, while cooling fluid is directed through the vapor compression system 14 first through the first condenser 34A and then through the second condenser 34B, thereby providing the series counter-flow arrangement.

As mentioned above, heat exchangers of the multiple refrigerant circuits 80 may be packaged together in a common heat exchanger shell. For example, in some embodiments, the first and second condensers 34A and 34B may be packaged in a common heat exchanger shell and/or first and second evaporators 38A and 38B may be packaged in a common heat exchanger shell. The common heat exchanger shell may be divided into a first pass and a second pass that are each associated with a respective heat exchanger of one of the refrigerant circuits 80. The first and second passes of the common heat exchanger shell may direct a cooling fluid or a conditioning fluid sequentially through tubes disposed within the first pass and tubes disposed within the second pass. To this end, the common heat exchanger shell may include a water box configured to re-direct a flow of the conditioning fluid from the tubes of the first pass to tubes of the second pass.

Figure 6:
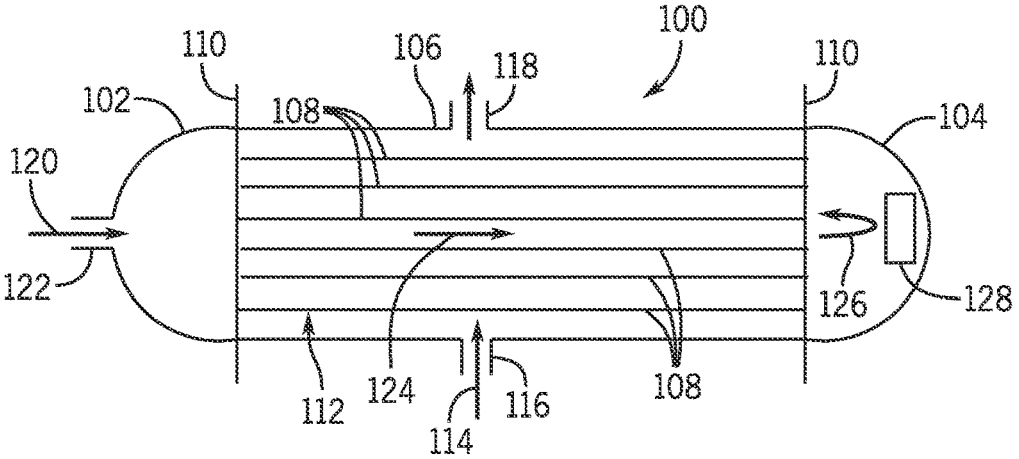
FIG. 6 is a schematic side view of an embodiment of a heat exchanger implemented with two refrigerant circuits of an HVAC&R system, in accordance with an aspect of the present disclosure.

For example, FIG. 6 is a cross-sectional schematic of a heat exchanger 100 (e.g., packaged heat exchanger, dual circuit heat exchanger, evaporator, condenser, etc.) that may be included in the vapor compression system 14. The heat exchanger 100 includes a first water box 102 and a second water box 104. The first water box 102 and the second water box 104 are coupled to a shell 106 of the heat exchanger 100 that has a plurality of tubes 108 disposed therein. The plurality of tubes 108 may be arranged and/or divided into tube bundles. The shell 106, the first water box 102, and the second water box 104 may be secured to one another via flanges 110. While the illustrated embodiment of FIG. 6 shows the flanges 110 having a larger diameter than the shell 106, the first water box 102, and/or the second water box 104, in other embodiments, the flanges 110 may include the same diameter as each of the shell 106, first water box 102, and/or second water box 104. Further, in other embodiments, the shell 106, the first water box 102, and/or the second water box 104 may be coupled to one another using another suitable technique (e.g., welding). Additionally, in some embodiments, each of the shell 106, the first water box 102, and/or the second water box 104 may be separate components that may be interchanged by coupling and/or removing such components from one another.

As mentioned above, the plurality of tubes 108 is arranged in one or more tube bundles 112 within the shell 106. In embodiments of the heat exchanger 100 configured as one or more flooded evaporators, a conditioning fluid (e.g., water, chilled fluid, etc.) is circulated through the plurality of tubes 108, and heat is transferred from the conditioning fluid to a refrigerant 114 that enters the shell 106 through an inlet 116 at a bottom of the shell 106. As heat is transferred from the conditioning fluid within the tubes 108 to the refrigerant 114, the refrigerant 114 evaporates and ultimately exits the shell 106 via an outlet 118 positioned at a top of the shell 106. It should be appreciated that the techniques disclosed herein may be utilized with heat exchangers 100 having other configurations. For example, the heat exchanger 100 may be a falling film evaporator, a hybrid falling film evaporator, a condenser, or other type of heat exchanger, and thus, the refrigerant 114 may enter and exit the shell 106 of the heat exchanger 100 at locations of the shell 106 other than those shown in FIG. 6. For example, in an embodiment of the heat exchanger 100 configured as a falling film evaporator, the inlet 116 and the outlet 118 may be positioned at a top of the shell 106.

In accordance with present techniques, the heat exchanger 100 may be configured as a multi-pass heat exchanger. More specifically, the plurality of tubes 108 within the shell 106 may be divided into a first subset of tubes and a second subset of tubes, where each subset of tubes is associated with a separate pass of the heat exchanger 100. In the illustrated embodiment, conditioning fluid 120 (e.g., water) enters the heat exchanger 100 via an inlet 122 of the first water box 102. However, in other embodiments, a cooling fluid, process fluid, or other fluid may enter the heat exchanger 100 via the inlet 102. The conditioning fluid 120 is directed from the first water box 102 to a first subset of the plurality of tubes 108, such that the conditioning fluid 120 flows through a first pass of the heat exchanger 100, as indicated by arrow 124. The conditioning fluid 120 exits the first subset of the plurality of tubes 108 and enters the second water box 104, which directs and/or redirects the conditioning fluid 120 to a second subset of the plurality of tubes 108, as indicated by arrow 126. The second subset of the plurality of tubes 108 defines a second pass of the heat exchanger 100. After the conditioning fluid 120 exits the second subset of the plurality of tubes 108, the conditioning fluid 120 may flow into the first water box 102 and may exit the first water box 102 via an outlet (not shown). To this end, the first water box 102 may include a partition plate configured to separate the conditioning fluid 120 flowing through the first water box 102 from the inlet 122 to the first subset of the plurality of tubes 108 and the conditioning fluid 120 flowing through the first water box 102 from the second subset of the plurality of tubes 108 to the outlet. The first and second passes of the heat exchanger 100 and the first and second subsets of the plurality of tubes 108 are shown in greater detail in FIG. 7.

As mentioned above, embodiments of the present disclosure are directed to a fluid mixing manifold 128 configured to sample and mix fluid flowing through the heat exchanger 100. More specifically, in the illustrated embodiment, the fluid mixing manifold 128 is positioned within the second water box 104 and is configured to sample conditioning fluid 120 flowing through the second water box 104 at different locations within the second water box 104. The fluid mixing manifold 128 is further configured to mix the sampled conditioning fluid 120 to generate mixed conditioning fluid 120. As noted above, the conditioning fluid 120 exiting each tube 108 in the first pass of the heat exchanger 100 may vary in temperature, for example, due to the individual heat transfer efficiency of each tube 108, among other factors. Thus, by sampling the conditioning fluid 120 at different locations within the second water box 104 and mixing the sampled conditioning fluid 120 to generate the mixed conditioning fluid 120, the fluid mixing manifold 128 enables efficient detection of an average temperature of the conditioning fluid 120 within the second water box 104 (e.g., between the first pass and the second pass of the heat exchanger 100). The detected average temperature of the conditioning fluid 120 within the second water box 104 and between the first and second passes of the heat exchanger 100 may be used as feedback to regulate operation of components of a system having the heat exchanger 100, such as the vapor compression system 14.

Figure 7:
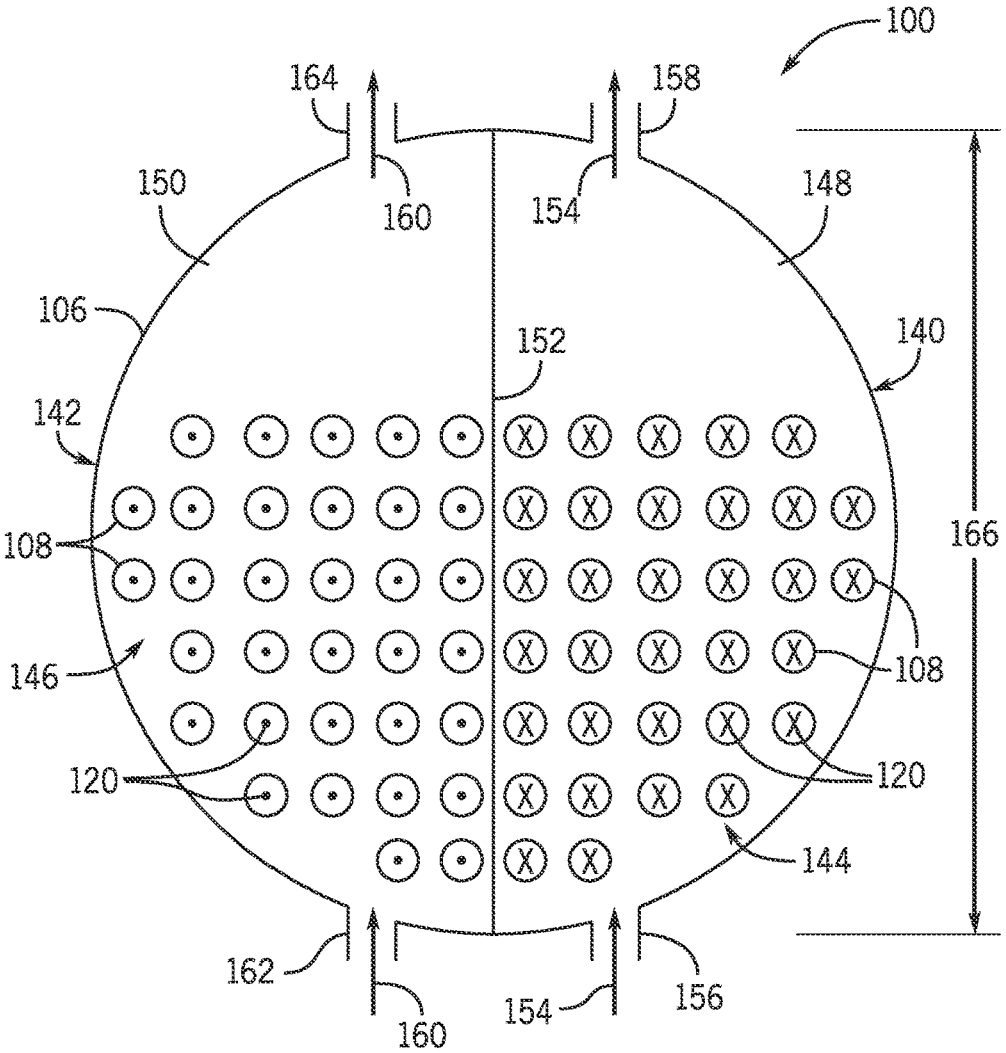
FIG. 7 is a schematic axial view of an embodiment of a heat exchanger implemented with two refrigerant circuits of an HVAC&R system, in accordance with an aspect of the present disclosure.

FIG. 7 is a schematic axial view of the heat exchanger 100, illustrating a first pass 140 and a second pass 142 of the heat exchanger 100. As mentioned above, the plurality of tubes 108 disposed within the shell 106 may be divided into a first subset 144 and a second subset 146. In the illustrated embodiment, the first subset 144 of tubes 108 defines the first pass 140 of the heat exchanger 100, and the second subset 146 of tubes 108 defines the second pass 142 of the heat exchanger 100. The first subset 144 of tubes 108 is positioned within a first volume 148 of the shell 106, and the second subset 146 of tubes 108 is positioned within a second volume 150 of the shell 106, whereby the first and second volumes 148 and 150 are divided or separated by a partition plate 152 disposed within the shell 106.

In some embodiments, the first and second passes 140 and 142 may each be associated with a respective refrigerant circuit configured to circulate a respective refrigerant. Thus, the heat exchanger 100 may be a component of a multi-circuit system (e.g., a two refrigerant circuit chiller). For example, the first pass 140 and the first volume 148 of the shell 106 may be components of the second evaporator 38B of the second refrigerant circuit 84 shown in FIG. 5, and the second pass 142 and the second volume 150 of the shell 106 may be components of the first evaporator 38A of the first refrigerant circuit 82 shown in FIG. 5. In some embodiments, the first pass 140 and the first volume 148 of the shell 106 may be components of the first condenser 34A of the first refrigerant circuit 82, and the second pass 142 and the second volume 150 of the shell 106 may be components of the second condenser 34B of the second refrigerant circuit 84. Thus, the heat exchanger 100 of the illustrated embodiment may include two heat exchangers (e.g., two evaporators, two condensers) packaged together in the shell 106. The following discussion describes operation of the heat exchanger 100 as including two evaporators packaged together in the shell 106, but it should be appreciated that other embodiments of the heat exchanger 100 may include two condensers packaged together.

As shown, a first refrigerant 154 is directed into the first volume 148 of the heat exchanger 100 via an inlet 156 of the shell 106. As described above, conditioning fluid 120 enters the first subset 144 of tubes 108 via the first water box 102. As the conditioning fluid 120 flows through the first subset 144 of tubes 108 in the first volume 148 (e.g. the first pass 140), heat is transferred from the conditioning fluid 120 to the first refrigerant 154, which may cool the conditioning fluid 120 and cause the first refrigerant 154 to evaporate. The evaporated first refrigerant 154 may then exit the first volume 148 of the shell 106 via an outlet 158 of the shell 106 and continue circulating through the refrigerant circuit associated with the first volume 148 and first pass 140 (e.g., second refrigerant circuit 84).

Similarly, a second refrigerant 160 is directed into the second volume 150 of the heat exchanger 100 via an inlet 162 of the shell 106. As mentioned above, the second refrigerant 160 and the first refrigerant 154 may be directed via separate refrigerant circuits (e.g., first and second refrigerant circuits 82 and 84). Conditioning fluid 120 is directed into the second subset 146 of tubes 108 from the second water box 104, as described above. As the conditioning fluid 120 flows through the second subset 146 of tubes 108 in the second volume 150 (e.g. the second pass 142), heat is transferred from the conditioning fluid 120 to the second refrigerant 160, which may further cool the conditioning fluid 120 and cause the second refrigerant 160 to evaporate. The evaporated second refrigerant 160 may then exit the second volume 150 of the shell 106 via an outlet 164 of the shell 106 continue circulating through the refrigerant circuit associated with the second volume 150 and second pass 142 (e.g., first refrigerant circuit 82).

As will be appreciated, it may be desirable to divide or balance a cooling load of the heat exchanger 100 between the two refrigerant circuits. To this end, respective components of the multiple refrigerant circuits may be individually operated to achieve a desired balance of the cooling load between the refrigerant circuits, and operation of the respective components of the multiple refrigerant circuits may be based, at least in part, on an average temperature of the conditioning fluid 120 within the second water box 104 (e.g., the conditioning fluid 120 between the first and second passes 140 and 142). Thus, present embodiments are directed to the fluid mixing manifold 128, which enables measurement of an average temperature of the conditioning fluid 120 within the second water box 104 while also mitigating pressure drop of the conditioning fluid 120 within the second water box 104. As discussed in further detail below, the fluid mixing manifold 128 is configured to sample conditioning fluid 120 within the second water box 104 at different locations (e.g., relative to a height 166 of the heat exchanger 100) within the second water box 104. In this way, the fluid mixing manifold 128 is configured to mix portions the conditioning fluid 120 within the second water box 104 to generate mixed conditioning fluid 120, the temperature of which may be measured to obtain and/or approximate an average temperature of the conditioning fluid 120 within the second water box 104.

Figure 8:
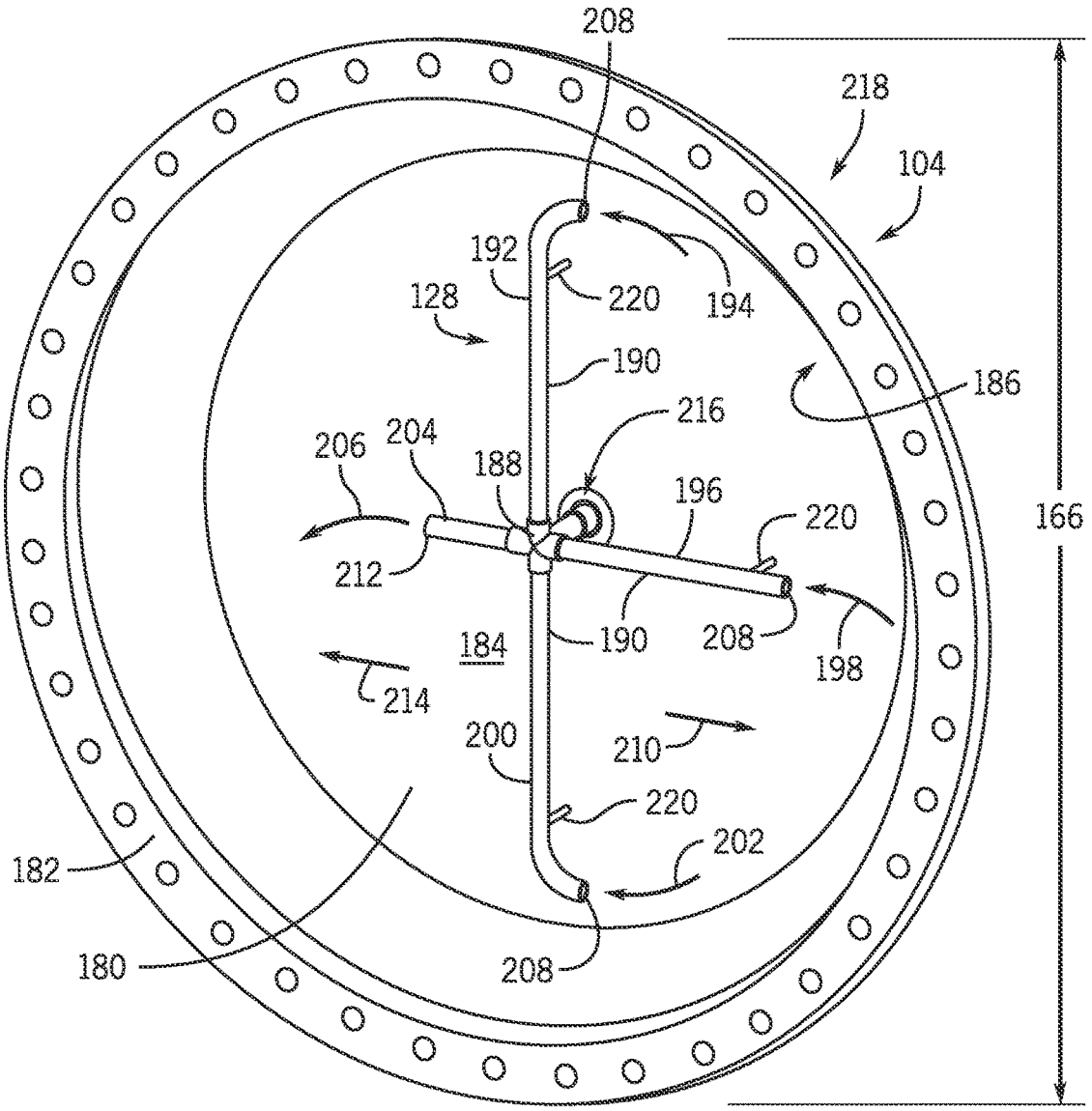
FIG. 8 is a perspective view of an embodiment of a water box having a fluid mixing manifold, in accordance with an aspect of the present disclosure.

FIG. 8 is a perspective view of an embodiment of the second water box 104, illustrating an embodiment of the fluid mixing manifold 128 disposed therein. The second water box 104 has a main body 180 (e.g., dome-shaped main body) and an outer flange 182, which may be configured to couple to one of the flanges 110 of the shell 106 of the heat exchanger 100. In an installed configuration, an inner volume 184 of the second water box 104, which is generally defined by the main body 180, receives the conditioning fluid 120 from the first subset 144 of tubes 108, and the main body 180 directs the conditioning fluid 120 to the second subset 146 of tubes 108. The main body 180 includes an inner surface 186 to which the fluid mixing manifold 128 is coupled (e.g., secured, mounted, affixed, etc.).

In the illustrated embodiment, the fluid mixing manifold 128 includes a mixing junction 188 and a plurality of sampling conduits 190 that extend from and are fluidly coupled to the mixing junction 188. Each sampling conduit 190 is configured to receive a flow of the conditioning fluid 120 within the second water box 104 and direct the flow of conditioning fluid 120 to the mixing junction 188 where the different sampled flows of conditioning fluid 120 are mixed to generate mixed conditioning fluid 120. More specifically, each sampling conduit 190 is configured to sample conditioning fluid 120 at a different location within the second water box 104, such as at different locations relative to the height 166 of the heat exchanger 100. For example, a first sampling conduit 192 is configured to receive a first flow of the conditioning fluid 120, as indicated by arrow 194, at a first location or height within the second water box 104, a second sampling conduit 196 is configured to receive a second flow of the conditioning fluid 120, as indicated by arrow 198, at a second location or height within the second water box 104, and a third sampling conduit 200 is configured to receive a third flow of the conditioning fluid 120, as indicated by arrow 202, at a third location or height within the second water box 104. The first, second, and third flows of conditioning fluid 120 mix within the mixing junction 188 to form the mixed conditioning fluid 120, and the mixed conditioning fluid 120 may be discharged from the fluid mixing manifold 188 via a discharge port 204 of the fluid mixing manifold 128, as indicated by arrow 206, that extends from and is fluidly coupled to the mixing junction 188.

Each sampling conduit 190 includes a respective inlet port 208 generally facing a first direction 210 (e.g., first lateral direction, first side of the second water box 104). The inlet ports 208 facing the first direction 210 also face a portion (e.g., a portion of the inner volume 184) of the second water box 104 that is generally aligned (e.g., relative to a longitudinal axis or length of the heat exchanger 100) with the first pass 140 and the first subset 144 of tubes 108. Thus, each sampling conduit 190 is arranged to effectively receive conditioning fluid 120 entering the second water box 104 from the first subset 144 of tubes 108 within the heat exchanger 100. The discharge port 204, on the other hand, includes an outlet 212 generally facing a second direction 214 (e.g., second lateral direction, second side of the second water box 104) opposite the first direction 210. The discharge port 212 facing the second direction 214 faces a portion (e.g., a portion of the inner volume 184) of the second water box 104 that is generally aligned (e.g., relative to a longitudinal axis or length of the heat exchanger 100) with the second pass 142 and the second subset 146 of tubes 108. Thus, the discharge port 204 effectively directs the mixed conditioning fluid 120 from the fluid mixing manifold 128 towards the second subset 146 of tubes 108 within the heat exchanger 100.

The fluid mixing manifold 128 further includes a sensor port 216 extending from the mixing junction 188. The sensor port 216 is fluidly coupled to the mixing junction 188 and extends through the main body 180 of the second water box 104 to an outer surface 218 of the main body 180. Accordingly, a sensor (e.g., a temperature sensor) may be inserted into the sensor port 216, and therefore into the mixing junction 188, from an exterior of the second water box 104. In this way, a sensor may be used to detect a temperature or other property of the mixed conditioning fluid 120 within the mixing junction 188.

In the illustrated embodiment, the fluid mixing manifold 128 includes generally tubular structures (e.g., sampling conduits 190) coupled to the second water box 104. In some embodiments, components of the fluid mixing manifold 128 may be formed from a metallic material, such as carbon steel, a polymeric material, or other suitable material. The mixing junction 188 is coupled to the second water box 104 via the sensor port 216, and the sampling conduits 190 are coupled to the second water box 104 via support extensions 220. Thus, the fluid mixing manifold 128 is offset from the inner surface 186 of the second water box 104. However, other embodiments of the fluid mixing manifold 128 may have other configurations. For example, the fluid mixing manifold 128 may have components directly fixed to the inner surface 186 of the main body 180 to form conduits or channels between the components and the inner surface 186 that are configured to receive flows of the conditioning fluid 120. In other embodiments, the fluid mixing manifold 128 may be disposed external to the inner volume 184 of the second water box 104 and may have conduits extending through the main body 180 to fluidly couple with the inner volume 184 and receive and/or discharge samples or flows of the conditioning fluid 120 at various locations within the second water box 104. In any case, the fluid mixing manifold 128 is configured to sample different portions or flows of the conditioning fluid 120 within the second water box 104 (e.g., from various locations along the height 166) and generate mixed conditioning fluid 120, the temperature of which may be measured to determine and/or approximate an average temperature of the conditioning fluid 120 within the second water box 104. Further, embodiments of the fluid mixing manifold 128 may reduce a pressure drop of the conditioning fluid 120 within the second water box 104 compared to traditional components configured to mix the conditioning fluid 120 within water boxes, such as baffles disposed therein. Indeed, as shown in the illustrated embodiment of FIG. 8, the fluid mixing manifold 128 occupies a relatively small amount of space within the inner volume 184, which does not impose significant flow restrictions on conditioning fluid 120 within the second water box 104 compared to traditional baffles and other mixing systems.

Figure 9:
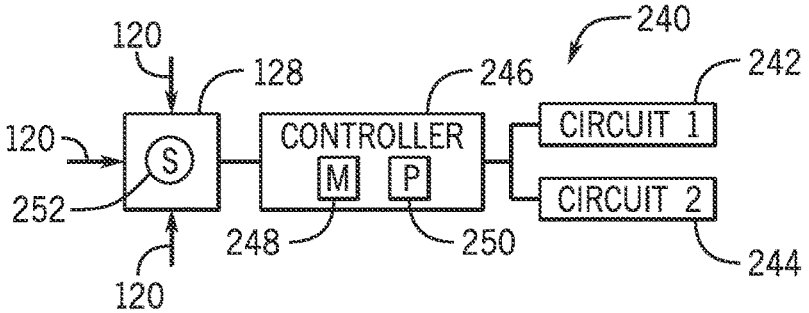
FIG. 9 is a schematic of an embodiment of a control system for an HVAC&R system having two refrigerant circuits and a fluid mixing manifold, in accordance with an aspect of the present disclosure.

FIG. 9 is a schematic of an embodiment of a control system 240 configured to measure and/or approximate an average temperature of the conditioning fluid 120 and control operation of an HVAC&R system (e.g., HVAC&R system 10, vapor compression system 14, etc.) based on the determined average temperature. For example, the control system 240 may configured to determine and/or approximate an average temperature of the conditioning fluid 120 within the heat exchanger 100 (e.g., within the second water box 104) discussed above. The control system 240 may be configured to regulate operation of various components of a first refrigerant circuit 242 (e.g., first refrigerant circuit 82) and a second refrigerant circuit 244 (e.g., second refrigerant circuit 84) that are used in conjunction with the heat exchanger 100.

The control system 240 includes a controller 246 having a memory 248 and processing circuitry 250, such as a microprocessor. The memory 248 may include volatile memory, such as random-access memory (RAM), and/or non-volatile memory, such as read-only memory (ROM), optical drives, hard disc drives, solid-state drives, or any other tangible, non-transitory computer-readable medium that includes (e.g., stores) instructions executable by the processing circuitry 250 to operate the HVAC&R system 10. The processing circuitry 250 may include one or more application specific integrated circuits (ASICs), one or more field programmable gate arrays (FPGAs), one or more general purpose processors, or any combination thereof, configured to execute the instructions stored in the memory 248 to operate the HVAC&R system 10.

The controller 246 is configured to receive feedback from one or more sensors 252. For example, one of the sensors 252 may be used with the fluid mixing manifold 128. As discussed above, the sensor 252 may be a temperature sensor configured to measure a temperature of mixed conditioning fluid 120 (e.g., within the mixing junction 188 of the fluid mixing manifold 128). Based on the measured temperature of the mixed conditioning fluid 120, the controller 246 may adjust operation of one or more components of the first refrigerant circuit 242 and/or the second refrigerant circuit 244 (e.g., any components of the first refrigerant circuit 82 and the second refrigerant circuit 84). In one embodiment, the controller 246 may adjust operation of the HVAC&R system 10 to balance a cooling load of the HVAC&R system 10 between the first refrigerant circuit 242 and the second refrigerant circuit 244. As an example, one or more of the sensors 252 may be configured to detect a temperature of the conditioning fluid 120 entering the heat exchanger 100 (e.g., entering the first water box 102 and directed to the first subset 144 of tubes 108) and to detect a temperature of the conditioning fluid 120 exiting the heat exchanger 100 (e.g., exiting the first water box 102 after flowing through the heat exchanger 100). Based on the detected temperatures of the conditioning fluid 120 entering and exiting the heat exchanger 100 and the temperature of the mixed conditioning fluid 120 within the second water box 104, the controller 246 may determine respective temperature differentials of the conditioning fluid across the first pass 140 and second pass 142 of the heat exchanger 100. The calculated temperature differentials may then be used to adjust operation of components (e.g., compressors, expansion devices, etc.) of the first refrigerant circuit 242 and/or the second refrigerant circuit 244 in order to achieve a desired balance of a cooling load (e.g., cooling load 88) on the HVAC&R system 10 having the heat exchanger 100. The controller 246 may also adjust operation of first refrigerant circuit 242, the second refrigerant circuit 244, and/or other components of the HVAC&R system 10 to load and/or unload the HVAC&R system 10 in a desirable manner.

As discussed above, present embodiments are directed to a fluid mixing manifold configured to sample fluid, such as cooling or conditioning fluid, at different locations within a water box of a heat exchanger, such as a heat exchanger incorporated with multiple refrigerant circuits. The fluid mixing manifold mixes the sampled fluids to generate a mixed fluid. The temperature of the mixed fluid may be measured and may be used to control operation of a vapor compression system having the heat exchanger, such as to balance a load shared by the multiple refrigerant circuits. The configuration of the fluid mixing manifold enables more accurate temperature measurements of the fluid for use in controlling operation of the vapor compression system and also enables a reduction in pressure drop of the fluid within the water box compared to traditional systems that are configured to generate a mixed fluid within the water box.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, air conditioning, and refrigeration (HVAC&R) system, comprising:

a heat exchanger comprising a shell having a first pass configured to place a fluid in a heat exchange relationship with a first refrigerant and a second pass configured to place the fluid in a heat exchange relationship with a second refrigerant and comprising a water box coupled to the shell and configured to direct the fluid from the first pass to the second pass; and a fluid mixing manifold disposed within the water box, wherein the fluid mixing manifold is configured to collect and mix a plurality of flows of the fluid from within the water box to generate a mixed fluid, and the fluid mixing manifold is configured to collect the plurality of flows of the fluid via a plurality of sampling conduits of the fluid mixing manifold; and a sensor coupled to the fluid mixing manifold, wherein the sensor is configured to measure a parameter of the mixed fluid.

2. The HVAC&R system of claim 1, wherein the parameter of the mixed fluid is a temperature of the mixed fluid.

3. The HVAC&R system of claim 1, wherein the fluid mixing manifold is configured to collect the plurality of flows of the fluid from within the water box from a plurality of locations within the water box.

4. The HVAC&R system of claim 3, wherein the plurality of locations is arrayed along a height of the heat exchanger.

5. The HVAC&R system of claim 1, wherein the fluid mixing manifold is configured to discharge the mixed fluid into the water box.

6. The HVAC&R system of claim 1, wherein the fluid mixing manifold comprises a mixing junction and the plurality of sampling conduits fluidly coupled to and extending from the mixing junction, wherein each sampling conduit of the plurality of sampling conduits is configured to collect and direct a respective one of the plurality of flows of the fluid from within the water box to the mixing junction.

7. The HVAC&R system of claim 6, wherein the sensor is disposed within the mixing junction.

8. The HVAC&R system of claim 6, wherein the fluid mixing manifold comprises a discharge port fluidly coupled to and extending from the mixing junction.

9. The HVAC&R system of claim 8, wherein each sampling conduit of the plurality of sampling conduits comprises a respective inlet facing a first direction, the discharge port comprises an outlet facing a second direction, and the first direction and the second direction are opposite one another.

10. The HVAC&R system of claim 1, wherein the heat exchanger comprises a plurality of tubes disposed within the shell, the shell comprises a first volume with a first subset of the plurality of tubes disposed therein and configured to direct the fluid to the water box, the shell comprises a second volume with a second subset of the plurality of tubes disposed therein and configured to receive the fluid from the water box, and wherein the first volume and the second volume are separated by a partition disposed within the shell.

11. The HVAC&R system of claim 10, wherein the first volume is configured to receive the first refrigerant from a first refrigerant circuit, the second volume is configured to receive the second refrigerant from a second refrigerant circuit, and the first refrigerant circuit and the second refrigerant circuit are fluidly separate from one another.

12. A heat exchanger, comprising:

a water box configured to direct a fluid from a first pass of the heat exchanger to a second pass of the heat exchanger; and a fluid mixing manifold disposed within the water box, wherein the fluid mixing manifold comprises:

a plurality of sampling conduits configured to collect and mix a plurality of flows of the fluid from a respective plurality of locations within the water box;

a mixing junction fluidly coupled to each sampling conduit of the plurality of sampling conduits, wherein the mixing junction is configured to mix the plurality of flows of the fluid to generate a mixed fluid; and a discharge port fluidly coupled to the mixing junction and configured to discharge the mixed fluid into the water box.

13. The heat exchanger of claim 12, comprising a sensor disposed within the fluid mixing manifold, wherein the sensor is configured to detect a temperature of the mixed fluid.

14. The heat exchanger of claim 13, wherein the fluid mixing manifold comprises a sensor port fluidly coupled to the mixing junction, the sensor port is attached to a main body of the water box, and the sensor extends into the sensor port.

15. The heat exchanger of claim 14, wherein the plurality of sampling conduits, the mixing junction, and the discharge port are offset from the main body of the water box via the sensor port and are suspended within an inner volume of the water box.

16. The heat exchanger of claim 12, wherein each sampling conduit of the plurality of sampling conduits comprises a respective inlet facing a first direction, the discharge port comprises an outlet facing a second direction, and the first direction and the second direction are opposite one another.

17. The heat exchanger of claim 16, wherein the inlets face a first portion of an inner volume of the water box that is aligned with the first pass of the heat exchanger, and the outlet faces a second portion of the inner volume of the water box that is aligned with the second pass of the heat exchanger.

18. A heating, ventilation, air conditioning, and refrigeration (HVAC&R) system, comprising:

a heat exchanger comprising a shell, a water box coupled to the shell, a partition disposed within the shell to define a first volume within the shell and a second volume within the shell, a first subset of tubes disposed within the first volume and configured to direct a fluid into the water box, and a second subset of tubes disposed within the second volume and configured to receive the fluid from the water box;

a fluid mixing manifold disposed within the water box, wherein the fluid mixing manifold comprises a plurality of sampling conduits, and the fluid mixing manifold is configured to collect a plurality of flows of the fluid from a plurality of locations arrayed along a height of the water box via the plurality of sampling conduits and is configured to mix the plurality of flows of the fluid to generate a mixed fluid; and a temperature sensor disposed within the fluid mixing manifold and configured to detect a temperature of the mixed fluid.

19. The HVAC&R system of claim 18, comprising:

a first refrigerant circuit configured to direct a first refrigerant into the first volume of the shell to exchange heat with the fluid directed through the first subset of tubes; and a second refrigerant circuit configured to direct a second refrigerant into the second volume of the shell to exchange heat with the fluid directed through the second subset of tubes, wherein the first refrigerant circuit and the second refrigerant circuit are fluidly separate from one another.

20. The HVAC&R system of claim 19, comprising a controller configured to receive feedback indicative of the temperature of the mixed fluid and to regulate operation of the first refrigerant circuit and the second refrigerant circuit based on the feedback.

* * * * *